United States Patent [19]

Fite

[11] 4,013,887

[45] Mar. 22, 1977

[54] METHODS AND APPARATUS FOR SPATIAL SEPARATION OF AC AND DC ELECTRIC FIELDS WITH APPLICATION TO FRINGE FIELDS IN QUADRUPOLE MASS FILTERS

[76] Inventor: Wade L. Fite, 305 Pasadena Drive, Pittsburgh, Pa. 15215

[22] Filed: Jan. 8, 1975

[21] Appl. No.: 539,587

Related U.S. Application Data

[62] Division of Ser. No. 346,250, March 30, 1973, Pat. No. 3,867,632.

[52] U.S. Cl. ..... 250/282; 250/290; 250/292; 313/326

[51] Int. Cl.[2] ..... H01J 1/00; H01J 39/34

[58] Field of Search ..... 333/79, 81 R, 73 R, 333/31 R, 12; 250/278, 281–283, 290, 293, 292; 313/352, 356, 326; 330/4.5, 4.6

[56] References Cited

UNITED STATES PATENTS

| | | | |
|---|---|---|---|
| 2,443,109 | 6/1948 | Linder | 333/97 X |
| 2,594,890 | 4/1952 | Ellwood | 333/97 X |
| 3,219,951 | 11/1965 | Clark | 333/79 |
| 3,668,573 | 6/1972 | Martin | 333/84 R |

*Primary Examiner*—Alfred E. Smith
*Assistant Examiner*—Marvin Nussbaum
*Attorney, Agent, or Firm*—Mason, Mason & Albright

[57] ABSTRACT

Methods for spatially separating ac and dc electric fields in which materials are used having characteristics as dielectrics to the ac fields and as conductors to the dc fields. The apparatus for separating the fields utilizes homogeneous materials of moderate to high resistivity. The method is applied to the separation of fringe fields near the ends of quadrupole mass filters for the purpose of improving the efficiency of ejection and transmission of ions in mass filter devices.

5 Claims, 7 Drawing Figures

METHODS AND APPARATUS FOR SPATIAL SEPARATION OF AC AND DC ELECTRIC FIELDS WITH APPLICATION TO FRINGE FIELDS IN QUADRUPOLE MASS FILTERS

RELATED APPLICATIONS

This is a division of application Ser. No. 346,250 filed Mar. 30, 1973 now U.S. Pat. No. 3,867,632.

BACKGROUND OF THE INVENTION

The quadrupole mass filter of W. Paul et al. described in U.S. Pat. No. 2,939,952, issued June 7, 1960, consists of four substantially parallel hyperbolic sheet electrodes (or cylindrical rods), symmetrically disposed about an axis. Opposite rods are electrically connected. On one pair of electrically connected oppositely disposed electrodes a dc voltage, U, and an ac voltage of amplitude, V, are placed. On the other pair of electrically connected oppositely disposed electrodes identical voltages, except having an electrical polarity opposite to the first pair, are placed. With proper settings of the dc voltage and the amplitude of the ac voltages, ions of a given charge-to-mass ratio have stable trajectories and oscillate about the axis whereby they do not collide with the electrodes; ions of other than the give charge-to-mass ratio are on unstable trajectories whereby they strike the electrodes. If ions are injected along the axis of the electrode structure, those with the given charge-to-mass ratio do not strike the electrodes and emerge from the opposite end of the electrode structure; however, ions with other than the given charge-to-mass ratio are accelerated in the transverse directions so that they collide with the electrodes and therefore do not emerge from the opposite end of the electrode structure. In this manner, the electrode structure functions as an ion "mass filter".

As noted in U.S. Pat. No. 3,129,327 to W. M. Brubaker of Apr. 14, 1964, an ion entering the electrode structure must pass through fringe fields near and beyond the end of the electrode structure. The ions must also pass through a similar fringe field in emerging from the opposite end of the electrode structure. As pointed out in the aforesaid patent of W. M. Brubaker, the ratio of the dc field strengths to ac field strength in the fringe fields are the same as in the electrode structure itself. Also, as disclosed in the aforesaid patent, an ion of the given charge-to-mass ratio, which is stable within the electrode structure proper, is on an unstable trajectory when it is in the fringe fields. Thus, although an ion would be stable within the electrode structure proper, it may not be received in the electrode structure proper due to its unstable trajectory in the fringe fields. This greatly reduces the transmission of ions of a given charge-to-mass ratio due to their rejection while within the fringe fields.

U.S. Pat. No. 3,129,327 further teaches that the ion trajectories can be stabilized on passage through the fringe fields provided that the ratio of the dc voltage (U) to the ac voltage amplitude (V) is reduced to a lower value than appropriate for use within the electrode structure proper. The aforesaid patent indicates several ways in which this can be accomplished in the case of quadrupole mass filters which have conventional metal electrodes. But the patent does not address itself to the broader problem of spatial separation of ac and dc fields emanating from the same metallic electrodes.

SUMMARY OF THE INVENTION

The present invention relates to spatial separation of fields emanating from electrodes, wherein such fields are produced from superpositions of the dc and time-varying voltages placed on the electrodes. More particularly, the specific application involved herein relates to fringe fields produced in the vicinity of ends of the electrode structure of a quadrupole mass filter.

Although the specific apparatus to which the methods and structure taught herein are applied is a quadrupole mass filter, the invention can be utilized in other devices, such as pulsed power devices, wherein from electrodes which carry both dc and time-varying voltages it is desirable to have fields which are separated in space.

For an understanding of the invention, reference is made to the fundamental equations describing electromagnetic fields known as Maxwell's equations. Using these equations for electric fields, it may be derived, for the electric field, E, within a medium having a dielectric constant, $\epsilon$, a magnetic permeability, $\mu$, and an electrical conductivity, $\sigma$, that:

$$\mathrm{div}(\epsilon\vec{E}) = 0 \tag{1}$$

$$\nabla^2\vec{E} = \frac{\mu\epsilon}{c^2}\left(\frac{\delta^2\vec{E}}{\delta t^2} + \frac{4\pi\sigma}{\epsilon}\ \frac{\delta\vec{E}}{\delta t}\right) \tag{2}$$

where $c$ is the velocity of light ($3 \times 10^{10}$ cm/sec).

Any time-varying field can be described in terms of a Fourier integral or series representation, in which a component of this representation will have a form of:

$$\vec{E} = \vec{E}_o e^{i\,\omega\,t} \tag{3}$$

where $E_o$ describes the spatial part of the field and the temporal part is given by $e^{i\,\omega\,t}$, where $t$ is the time, and $\omega = 2\pi f$, where $f$ is the frequency in Hertz, and $i$ is the square root of $-1$.

By substitution of Equation (3) in Equation (2), the following results:

$$\nabla^2 E_o = \frac{-\omega^2\mu\epsilon}{c^2}\left(1 - i\,\frac{4\pi\sigma}{\epsilon\omega}\right)E_o \tag{4}$$

From the foregoing, it will be understood that for materials and frequencies wherein $4\pi\sigma/\omega\epsilon$ is very much less than unity, the second term in the parenthesis in Equation (4) can be neglected in comparison to the first term in parenthesis and, accordingly, the material effectively acts as a dielectric material. If the same quantity, $4\pi\sigma/\omega\epsilon$, is very much greater than unity, the material acts as a conductor. Thus, at sufficiently high frequencies, the material acts as a dielectric material whereas the same material acts as a conductor at lower frequencies, including the dc case, with a frequency of zero.

It is well known from the theory of electromagnetism (see: J. D. JACKSON, CLASSICAL ELECTRODYNAMICS, 1962, John Wiley & Sons, or other standard texts) that at the interface between a vacuum and a dielectric material there must be mathematical continuity of the vector component of the electrical field which is tangential to the surface of the interface, and also mathematical continuity of the product of the vector component of the electric field normal to the interface and the dielectric constant of the medium. This implies that there is a slight change of direction of an electric field in going from vacuum into a material with a dielectric constant greater than unity and a further slight change in direction in emerging from the material into vacuum on the other side of the material. Such changes of direction are illustrated in CLASSICAL ELECTRODYNAMICS, Supra, FIG. 4.7, page 113. There is also a reduction of the strength of the field which occurs inside the dielectric material and a corresponding strengthening of the field in the vacuum adjacent to the dielectric material. For purposes of the present invention, the important point is that the presence of a piece of dielectric material in a region otherwise occupied by vacuum causes only a minimal change in the shape and field strength relative to what would exist had the dielectric material not been placed there. It thus follows that materials which have the proper ratio of conductivity to dielectric constant for fields of a given frequency wherein the material functions as a dielectric only slightly distort the fields relative to that which would be present if such material were not present.

It is known from the theory of electromagnetism that when conductors are present, electric field lines must terminate at the surfaces of conductors with the direction of the field being perpendicular to the interface between the conducting material and the vacuum. It follows that a hollow tube of conducting material placed in an electric field shields against the electric field, provides a field free space within the tube and at the same time substantially distorts fields outside and adjacent to the tube. Thus, as utilized in the present invention, placement of a tube or similar shape of material which conducts electricity substantially distorts the fields and leave no fields within the tube itself. Accordingly, it follows that a tube of material which acts as a dielectric to the ac fields but as a conductor to the dc fields of a quadrupole mass filter minimally distorts the ac fields and the ac fields are thus reduced without substantial distortion within the interior of the tube, whereas the tube completely excludes dc fields from its interior. Thus, a tube or other configuration of a material with the proper dielectric constant and electrical conductivity achieves a spatial separation of the ac and dc fringe fields which would otherwise exist coincident in space if the tube were not present.

Typical quadrupole mass filters have ac voltages at frequencies of about $10^6$ Hz ($\omega$ of the order of $10^7$ $sec^{-1}$) superposed on dc fields. According to the theory, materials with dielectric constants of the order of 10 should act effectively as dielectrics if their conductivities are substantially less than about $10^7$ electrostatic units. In more conventional notation, materials act as dielectrics if their resistivities are very much higher than about $10^5$ ohm-cm. Such materials are considered to be "leaky dielectrics," and are available in known ceramics and ferrite materials.

BRIEF DESCRIPTION OF THE DRAWINGS

The invention is illustrated in preferred embodiments applied to quadrupole mass filters, in which.

DESCRIPTION OF THE PREFERRED EMBODIMENTS

Figure 1A:
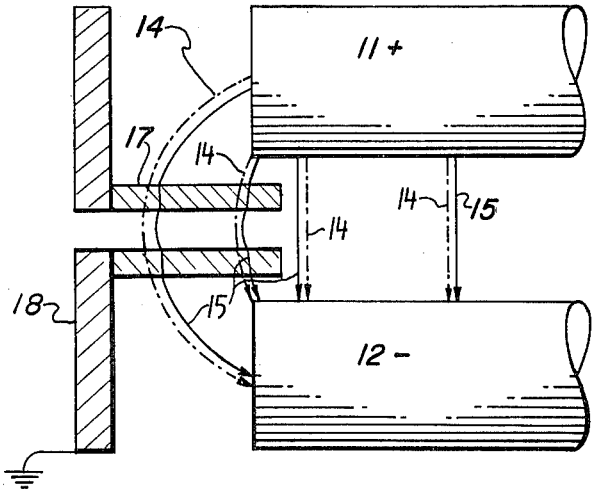
FIG. 1*a* diagrammatically illustrates the effect of a pure dielectric having a tube form inserted into a mass filter.
Figure 1B:
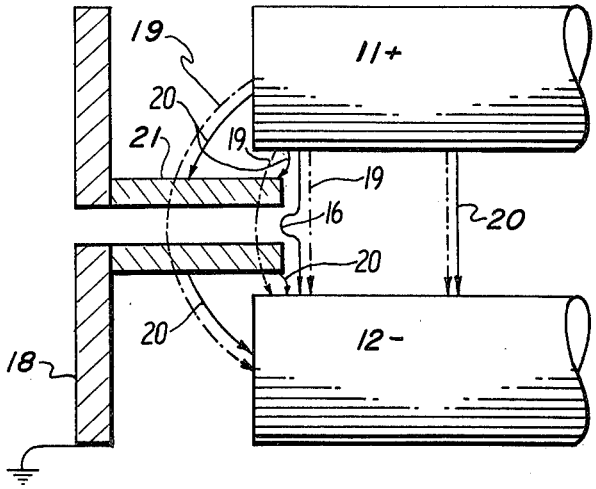
FIG. 1*b* is similar to FIG. 1*a* except that the tube is composed of an electrically conductive material.
Figure 1C:
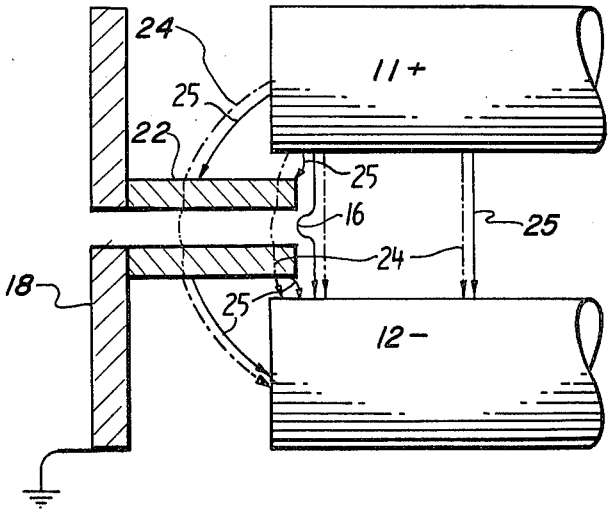
FIG. 1*c* is similar to FIGS. 1*a* and 1*b* except that the material acts as a dielectric to electric fields generated by the ac voltages and as a conductor to the electric field from a dc voltage.

Referring now to FIGS. 1*a*, 1*b* and 1*c*, FIG. 1*a* illustrates the effect of having a pure dielectric, in the form of a tube 117 extending into a quadrupole filter between the electrodes at one end thereof, and the change of the electric field lines thereby created. Thus, FIG. 1*a* shows two electrodes 11 and 12 of positive and negative polarities, respectively, which are adjacent to each other. The dot-dash lines designated 14, show the fields line that would be present if the tube 17 of dielectric material (shown in section) were not in place. The solid lines designated 15, shown the field lines as they are altered by placing tube 17 of pure dielectric material mounted on electrode 18 (shown in section) in the position shown. In practice, the field lines 14 and 15 are practically coincident except for slight displacement through tube 17 which is exaggerated in the Figure. Thus, it is to be understood that the lines 14 and 15 are shown separated for clarity. The principal point of this figure is to illustrate that the tube of dielectric material distorts the field lines only slightly from the positions they would have in the absence of tube 17 of dielectric material.

FIG. 1*b* illustrates the situation where a tube 21 of an electrically conducting material is substituted for tube 17 of dielectric material. The dot-dash lines, designated 19, show the field lines as exist if the tube were absent, and the solid lines 20 illustrate the field lines with conducting tube 21 (shown in section) in place with its end away from the mass filter being connected to ground through an electrode 18 (shown in section), upon which the tube 21 may be mounted. This figure illustrates that with tube 21 composed of a conducting material the field lines are distorted substantially more strongly that with tube 17 of dielectric material and that tube 21 excludes fields from the interior of tube 17. Again, it should be understood that lines 19 and 20 have been separated for clarity in FIG. 1*b*. Lines 19 do not pass through tube 21 and a slight bulge 16 is created in lines 19 near and towards the opening of tube 21 into the electrode structure 11 and 12. Otherwise lines 19 and 20 are practically coincident.

FIG. 1*c* shows the situation for fringe fields which affect ions received at the end entrance of a quadrupole mass filter, the mass filter electrodes 11 and 12 having superposition of ac and dc voltages placed upon them. The tube 22 mounted on electrode 18 (shown in section) is composed of an appropriate material which functions as a dielectric to the ac electric field lines, shown as dot-dash lines designated 24 and as a conductor to the dc electric field lines shown as solid lines designated 25. The effect of tube 22 is to exclude dc fringe fields within the tube 22 and to move the dc fringe fields as compared to the ac fringe fields, which continue to extend away from the end of the mass filter and penetrate into the interior region of tube 22. The lines 24 and 25 are separated in FIG. 1*c* as in FIGS. 1*a* and 1*b*. However, with the exceptions noted in describing the field lines shown in such figures the field lines are otherwise practically coincident.

In the configuration shown in FIG. 1*c*, the fact that the material is a conductor to dc electricity ensures that any ions accidentally striking the interior walls of tube 22 will have their charge discharged to ground through the material itself via electrode 18. Thus, with proper selection of materials, the device remains free of charging which would afflict any normal dielectric material of very low conductivity.

Materials exist which, in addition to having appropriate values of the dielectric constant and sufficiently high resistivities, have magnetic permeabilities sufficiently high as to act as magnetic shields to any stray magnetic fields which might adversely affect the entry of ions through the tube and into the mass filter. Known ferrites constitute an example of such materials. As presented heretofore, the tube of FIG. 1*c* is described as a tube of uniform homogeneous material with the appropriate values for the dielectric constant, magnetic permeability and electrical conductivity.

Figure 2:
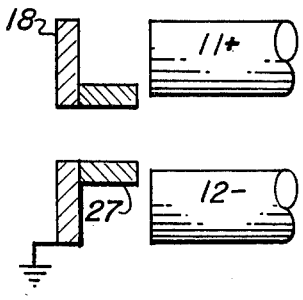
FIG. 2 diagrammatically illustrates an embodiment wherein a tube in accordance with the invention is located adjacent to but outside of the electrode structure of quadrupole mass filter.

The invention is not restricted to a geometry shown in FIG. 1*c*. A modification of this invention, which places a tube 27 mounted on electrode 18 (shown in section) entirely outside the quadrupole mass filter electrode structure 11 and 12, is illustrated in FIG. 2.

Figure 3:
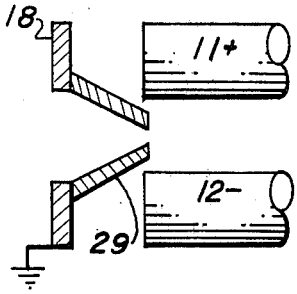
FIG. 3 is similar to FIG. 2 except that a funnel or conical member takes the place of the cylindrical tube.

FIG. 3 shows another modification which uses a cone of funnel member 29 mounted on electrode 18 (shown in section) of the leaky dielectric material placed so that the point of the cone extends toward or into the electrode structure 11 and 12 of the quadrupole mass filter.

Figure 4:
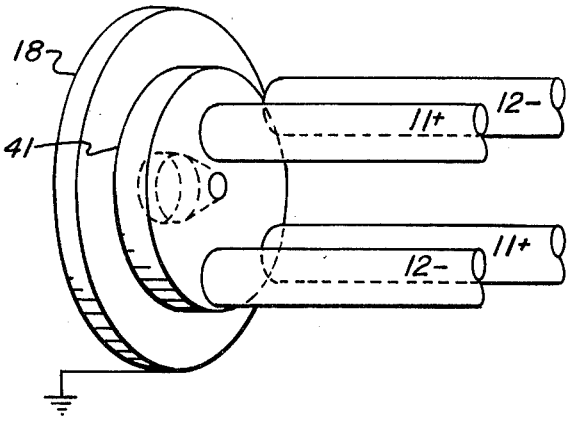
FIG. 4 is a perspective view of a further embodiment of the invention wherein the material for effecting separation of the dc and ac generated electric fields is in the form of an annulus located at the end of the electrode structure of a quadrupole mass filter.

FIG. 4 illustrates a further modification of the invention as applied to the ion entrance of a quadrupole mass filters, wherein mounted on electrode 18, an annulus 41 composed of appropriate material is placed at the entrance end of the electrode structure of the mass filter with the interior surfaces of the annulus being shaped to improve admission of ions through annulus 41 into the mass filter electrode structure 11 and 12.

Figure 5:
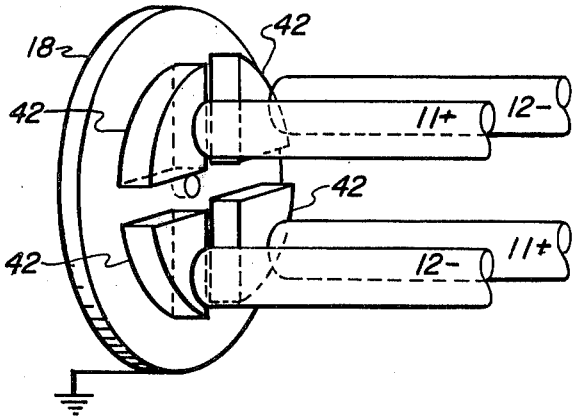
FIG. 5 is a view of an embodiment of the invention similar to Figure except that the annulus is replaced by a plurality of separated members having dielectric characteristics in accordance with the invention.

FIG. 5 shows still another modification of the invention, applied to quadrupole mass filters, wherein a single piece of leaky dielectric material is replaced by two or more (shown as four) separate pieces 42 of appropriate material, the purpose being to prevent currents which would be generated by the fields in a solid piece from producing too much energy dissipation therein, there being no restriction on the specific shapes of the separate pieces of leaky dielectric material as long as the desired function is obtained.

Although FIG. 5 shows the leaky dielectric material physically separated from the ends of the poles 11 and 12 of the quadrupole mass filter, such a physical separation is not considered necessary provided that the resistivity of the material is sufficiently high, that is, in excess of about $10^8$ ohm-cm for a homogeneous material.

Referring again to the FIG. 1*c* embodiment, an Extranuclear Laboratoris, Inc. Mass Filter, Model 162-8, which has as is main electrode (pole) structure a set of four parallel rods 11 and 12 of circular cross section, measuring about ⅜ inches in diameter located so that their longitudinal axes lie equidistantly on a circle of approximately 11/32 inches in radius which is perpendicular to said longitudinal axes and having a length of 8 inches, was used. The tube 22 was composed of a material known as "Ceramag C/12," (a carbon-nickel-zinc ceramic) manufactured by Stackpole Carbon Co., of St. Mary's, Pa. This material, which has a dielectric constant of 10 and a volume resistivity of $3.0 \times 10^7$ ohm-cm, was in the form of a cylindrical tube of $\theta$ inch outside diameter and ⅛ inch inside diameter. Tube 22 was mounted in a stainless steel end plate for the mass filter case, said end plate constituting the grounded electrode 18. The distance of end plate 18 from the ends of poles 11 and 12 was approximately 0.30 inch. The end of tube 22 (not connected to end plate 18) extended a distance of approximately 0.10 inch into the electrode structure 11 and 12 of the quadrupole along its axis, as shown in FIG. 1*c*. The particular material used had a stated magnetic permeability of 35. Thus, it provided some shielding of stray magnetic fields from the electric currents used in an ionizer included in the instrument, which produce ions by electron impact ionization of gases, located just outside (and away from the rod structure 11 and 12) of the mass filter. With the arrangement described, a very substantial improvement in the performance of the quadrupole mass filter was obtained. At masses of about 200 atomic mass units (AMU) (Mercury ions), the mass filter showed an improvement in resolution going from about 1500 FWHM (Full-width-half-maximum) without the tube to about 5000 FWHM within the tube. The sensitivity of the instrument at mass 200 was increased by a factor of about 100. Without the tube of Ceramag C/12, the minimum kinetic energy of the ions which upon injection to the mass filter produced satisfactory signals was about 9eV; but with the tube in place, ample signals could be obtained with an ion kinetic energy of only about 3.0 eV. Thus, the presence of the tube at the entrance end of the mass filter enhanced transmission, resolution and reduced the minimum ion energy required to use the mass filter. At greater masses, such as at the doublet in the spectrum of perfluorotributylamine, at 614 and 615 atomic mass units, whereas the mass filter used without the Ceramag tube installed, was barely capable of fully separating the two mass peaks, with the tube in place, the peaks were fully separated with the ratio of the distance between the peaks divided by the width of the peaks at their base being approximately 5, i.e., a resolution of about 6000 FWHM was achieved, using an ion energy of only about 4 eV. This degree of resolution and sensitivity has never before been achieved in the mass quadrupole spectrometer technology.

The same general configuration was tried using four different Extranuclear Laboratories mass filters, and the same improvement in results were repeated. Using three different tubes of the Ceramag material of the same dimensions also gave reproducibility of results. The experiment was scaled up to use an Extranuclear Laboratories Mass Filter, Model 324-9, which has circular rods of ¾ inch diameter and length 9 inches. The longitudinal axes of the rods are located equidistantly apart on a circle perpendicular to said axes which has a radius of about 11/16 inch. The Ceramag tube was replaced by a further tube of the same material with the dimensions approximately doubled. It was found that the results were again duplicated, and the results further indicated the separation of the mass doublet $N_2$ and CO, both occurring at nominal mass 28 AMU, with a fractional difference of approximately 1 part in 3000, and of separation of isotopes of $H_2$, D, $D_2$, He and other species in the first four atomic mass units.

Addition of a similar tube to the exit end of the mass filter further enhanced the transmission and resolution characteristics of the mass filters, although it appears that the conditions at the entrance end of the mass filter are more critical than those at the exit end of the mass filter.

In a second configuration, namely that of FIG. 2, a mass filter of rod diameter ⅜ inch was used. However, the Ceramag tube 27 had an outside diameter of approximately ½ inch, so that it could not be inserted within the poles 11 and 12 of the mass filter electrode structure. The larger diameter tube 27 was placed just beyond the ends of the poles 27 of the mass filter. The presence of tube 27 gave some improvement in the characteristics of the mass filter's performance, but the improvements were not as great as when the smaller tube 22 which inserted into the entrance of poles 11 and 12 shown in FIG. 1*c* was used.

As shown in FIG. 3, the tube of Ceramag material was replaced by a cone 29 of the same material. Cone 29 had a wall thickness of approximately 3/32 inch, an aperture opening of approximately ⅛ inch diameter, and a cone half-angle of approximately 45°. The end of cone 29 was approximately coincident with the end of poles 11 and 12 of the mass filter. It was found that cone 29 also improved the performance of the mass filter, but, again not to the extent of the tube 27 arrangement shown in FIG. 1*c*.

On the basis of experience with the arrangement disclosed with reference to FIGS. 2 and 3, the configuration shown in FIG. 1*c* is considered the preferred embodiment. However, it is anticipated that further configurations, arrangements, and materials may result in further improvements. In particular, the experience gained to date suggests that materials with higher magnetic permeabilities and lower bulk resistivities can be used (such as Stackpole Carbon Company's Ceramag material No. C/9), without deleterious effects from conductive and dielectric heating. Ceramage C/12 has been used rather than a material of lower resistivity to avoid problems of excessive heating of the material during initial tests of the invention.

It will be understood by those skilled in the art from the foregoing disclosure that the material for separating the electrical fields may be utilized in shapes other than those illustrated and described. For example, in lieu of a cylindrical tube 22, a tube having rectangular or square cross-sectional configuration may be employed. Also, the shape may conform, more or less, to the shape of the space at the insertion of the tube between the four poles.

Having described my invention, what I claim as new and desire to cover by Letters Patent of the United States is:

1. In a method of spatially separating ac and dc electric fields, the use of a material which functions substantially as a material having high dielectric constant to the ac fields and substantially as an electrical conductor to the dc fields, the method comprising the subjecting of a spatial volume to a said ac electric field and a said dc electric field and the placing of a shield of said material whereby it intercepts said fields before their receipt in said volume, said shield of said material thereby shielding said volume from said dc electric field and permitting said ac electric field to be received in said volume.

2. A method in accordance with claim 1, wherein frequency of the AC fields is in excess of about 1 mega hertz and the material has a dielectric constant in the range of about between 1 and 50 and a resistivity in excess of about $10^5$ ohm-cm.

3. A method in accordance with claim 2 wherein the material has a magnetic permeability in a range of between about 1 and 1,000.

4. In a method of spatially separating ac electric fields at two different frequencies, one frequency being substantially lower than the other frequency, the use of a material which functions substantially as a material having a high dielectric constant to the fields of the higher of said frequencies and substantially as an electrical conductor to the fields of the lower of said frequencies, the method comprising the subjecting of a spatial volume to said higher frequency electric field and to said lower frequency electric field and the placing of a shield of said material whereby it intercepts said fields before their receipt in said volume, said shield of said material thereby shielding said volume from said lower frequency electric field and permitting said higher frequency electric field to be received in said volume.

5. A method in accordance with claim 4 wherein the lower of said frequencies is substantially zero.

* * * * *